US009534443B1

(12) United States Patent
Bogart et al.

(10) Patent No.: US 9,534,443 B1
(45) Date of Patent: Jan. 3, 2017

(54) LADDER AND RELATED METHODS

(71) Applicants: Robert C. Bogart, Prescott, AZ (US); Kelli S. Bogart, Prescott, AZ (US); Miles Frank Swain, Chino Valley, AZ (US); Debra Ann Swain, Chino Valley, AZ (US); James Joseph McKeon, Bagdad, AZ (US); Kimberly Louise McKeon, Bagdad, AZ (US)

(72) Inventors: Robert C. Bogart, Prescott, AZ (US); Kelli S. Bogart, Prescott, AZ (US); Miles Frank Swain, Chino Valley, AZ (US); Debra Ann Swain, Chino Valley, AZ (US); James Joseph McKeon, Bagdad, AZ (US); Kimberly Louise McKeon, Bagdad, AZ (US)

( * ) Notice: Subject to any disclaimer, the term of this patent is extended or adjusted under 35 U.S.C. 154(b) by 0 days.

(21) Appl. No.: 13/727,964

(22) Filed: Dec. 27, 2012

Related U.S. Application Data

(60) Provisional application No. 61/580,570, filed on Dec. 27, 2011.

(51) Int. Cl.
*E06C 1/39* (2006.01)
*E06C 1/383* (2006.01)
*E06C 7/16* (2006.01)

(52) U.S. Cl.
CPC ..... *E06C 1/383* (2013.01); *E06C 1/39* (2013.01); *E06C 7/16* (2013.01)

(58) Field of Classification Search
CPC ..... E06C 7/14; E06C 7/44; E06C 7/423; E06C 7/50; E06C 1/383; E01C 1/393; E01C 1/20; E01C 1/32; E01C 1/39; E01C 1/16

(Continued)

(56) References Cited

U.S. PATENT DOCUMENTS 160,081 A 2/1875 Carnes
419,821 A 1/1890 Burrows
(Continued)

FOREIGN PATENT DOCUMENTS

EP 0047151 A2 8/1982
EP 0940555 A2 9/1999
(Continued)

OTHER PUBLICATIONS

Ameristep the Raptor triopod and Grizzly tripod, offered for sale on www.huntingfishingdirect.com, last accessed Aug. 29, 2010.

(Continued)

*Primary Examiner* — Daniel Cahn
(74) *Attorney, Agent, or Firm* — Adam R. Stephenson, Ltd.

(57) ABSTRACT

A ladder. A step is coupled to a primary leg, an adjustable base is coupled to the primary leg, the adjustable base includes a first base section rotatably coupled to a second base section and the second base section is coupled to the primary leg. An adjuster retains the first base section at one of a plurality of rotations with respect to the second base section. In implementations a secondary leg is coupled to the primary leg proximate a top of the ladder and a movable section is coupled to the primary leg with an arm and further coupled to the secondary leg with an arm, the movable section having a substantially planar upper surface configured to generally face the top of the ladder when the ladder is in an open configuration and configured to generally face the top of the ladder when the ladder is in a closed configuration.

8 Claims, 4 Drawing Sheets

(58) Field of Classification Search
USPC ..... 182/165, 171, 170, 176, 25, 129, 152
See application file for complete search history.

(56) References Cited

U.S. PATENT DOCUMENTS

| | | | | | |
|---|---|---|---|---|---|
| 461,366 | A | | 10/1891 | Odem | |
| 538,570 | A | | 4/1895 | White | |
| 554,695 | A | * | 2/1896 | Hood | E06C 1/34 182/116 |
| 569,170 | A | | 10/1896 | McCormick | |
| 621,479 | A | | 3/1899 | Stephenson | |
| 839,087 | A | | 12/1906 | Adler | |
| 947,409 | A | | 1/1910 | Hudson | |
| 970,560 | A | | 9/1910 | Samuelson | |
| 1,088,168 | A | | 2/1914 | Osterhoudt | |
| 1,088,169 | A | | 2/1914 | Osterhoudt | |
| 1,280,741 | A | | 10/1918 | Nunn | |
| 1,354,166 | A | | 9/1920 | Busko | |
| 1,496,459 | A | * | 6/1924 | Gilbert | 182/105 |
| 1,551,395 | A | | 8/1925 | Husted | |
| 1,589,743 | A | | 6/1926 | Clary | |
| 1,733,338 | A | | 10/1929 | Enke | |
| 1,866,974 | A | | 7/1932 | Hohing et al. | |
| 1,873,107 | A | | 8/1932 | Blosser | |
| 1,944,099 | A | * | 1/1934 | Mearkle | 182/176 |
| 2,305,985 | A | | 5/1941 | Obermeyer | |
| 2,364,048 | A | * | 12/1944 | Barkey | E06C 1/20 182/172 |
| 2,409,266 | A | * | 10/1946 | Fowler | 182/173 |
| 2,500,333 | A | | 3/1950 | Young | |
| 2,580,045 | A | | 12/1951 | Reed | |
| 2,650,014 | A | * | 8/1953 | Harrison | 182/170 |
| 2,930,442 | A | | 3/1960 | Carter | |
| 3,042,142 | A | | 7/1962 | Butler | |
| 3,165,169 | A | | 1/1965 | Machen | |
| 3,189,124 | A | | 6/1965 | Rateau | |
| 3,693,756 | A | | 9/1972 | Walker et al. | |
| 3,858,684 | A | | 1/1975 | Goings | |
| 3,878,917 | A | | 4/1975 | McBride | |
| 3,933,221 | A | | 1/1976 | Sorenson | |
| 3,964,574 | A | | 6/1976 | Bentivegna | |
| 4,029,223 | A | | 6/1977 | Adamski et al. | |
| 4,085,820 | A | | 4/1978 | Cerny | |
| 4,135,690 | A | | 1/1979 | Clarke et al. | |
| 4,331,217 | A | | 5/1982 | Stecklow | |
| 4,366,940 | A | | 1/1983 | Vargas | |
| 4,418,793 | A | | 12/1983 | Brent | |
| D273,996 | S | | 5/1984 | Rasler | |
| 4,497,390 | A | | 2/1985 | Wilson | |
| 4,524,849 | A | | 6/1985 | Riddle | |
| 4,600,080 | A | | 7/1986 | Forrester | |
| 4,618,027 | A | | 10/1986 | Piretti | |
| 4,646,876 | A | | 3/1987 | Grawi | |
| 4,766,976 | A | | 8/1988 | Wallick, Jr. | |
| 4,796,727 | A | | 1/1989 | Eaton | |
| 4,846,305 | A | | 7/1989 | Kupfert | |
| 4,899,849 | A | | 2/1990 | Levi et al. | |
| 4,949,809 | A | | 8/1990 | Levi et al. | |
| 4,978,098 | A | | 12/1990 | Peckinpaugh | |
| 5,012,895 | A | | 5/1991 | Santos | |
| 5,044,468 | A | | 9/1991 | Worthington, Jr. | |
| 5,058,707 | A | | 10/1991 | Waid | |
| 5,064,024 | A | | 11/1991 | Barham | |
| 5,154,255 | A | | 10/1992 | Kiska et al. | |
| 5,335,754 | A | | 8/1994 | Gibson | |
| 5,526,898 | A | | 6/1996 | Clark | |
| 5,542,497 | A | | 8/1996 | Macyszyn | |
| D373,428 | S | | 9/1996 | Nashleanas et al. | |
| 5,584,357 | A | | 12/1996 | Gugel et al. | |
| 5,590,739 | A | | 1/1997 | High et al. | |
| D380,559 | S | | 7/1997 | Sweeney | |
| 5,678,656 | A | | 10/1997 | Lanzafame | |
| 5,685,391 | A | * | 11/1997 | Gundlach | E06C 1/18 182/104 |
| D388,882 | S | | 1/1998 | Kain | |
| 5,715,909 | A | | 2/1998 | Gagnon | |
| 5,722,507 | A | | 3/1998 | Kain | |
| 5,791,437 | A | | 8/1998 | Figliuzzi | |
| 5,845,744 | A | | 12/1998 | Beck et al. | |
| 5,853,065 | A | | 12/1998 | Hutson et al. | |
| 6,044,929 | A | | 4/2000 | Wishner | |
| 6,098,749 | A | | 8/2000 | Enochs | |
| 6,145,620 | A | | 11/2000 | Strunk | |
| 6,158,551 | A | | 12/2000 | Gray | |
| 6,206,139 | B1 | | 3/2001 | Bogart, Jr. | |
| 6,253,876 | B1 | | 7/2001 | Cosgrave et al. | |
| 6,341,666 | B1 | | 1/2002 | Allen | |
| 6,502,664 | B1 | | 1/2003 | Peaker, Sr. | |
| 6,672,427 | B1 | | 1/2004 | Sheffield | |
| 6,688,426 | B1 | | 2/2004 | Mikros | |
| 6,698,699 | B1 | | 3/2004 | Bailey | |
| 6,810,995 | B2 | | 11/2004 | Warford | |
| 6,874,598 | B1 | * | 4/2005 | Baker | E06C 1/38 182/165 |
| 6,910,666 | B2 | | 6/2005 | Burr | |
| D507,079 | S | | 7/2005 | Drum | |
| 6,986,405 | B2 | * | 1/2006 | Meeker | 182/176 |
| 7,036,633 | B2 | | 5/2006 | Lanzafame | |
| 7,051,837 | B1 | | 5/2006 | Brahier | |
| 7,887,016 | B2 | | 2/2011 | Gunsaullus | |
| 7,967,264 | B1 | | 6/2011 | Peterson | |
| 8,186,480 | B1 | * | 5/2012 | Yoakum, Jr. | 182/118 |
| 8,186,481 | B2 | | 5/2012 | Moss et al. | |
| 8,381,875 | B2 | * | 2/2013 | Leng | 182/116 |
| 2002/0178683 | A1 | | 12/2002 | Phillips | |
| 2006/0192071 | A1 | * | 8/2006 | Choi | 248/460 |
| 2007/0181369 | A1 | * | 8/2007 | Gibson et al. | 182/165 |
| 2008/0078616 | A1 | | 4/2008 | Ursitti | |
| 2009/0229918 | A1 | * | 9/2009 | Moss et al. | 182/129 |
| 2010/0252364 | A1 | | 10/2010 | Vestal et al. | |
| 2012/0048647 | A1 | | 3/2012 | Green et al. | |
| 2012/0261214 | A1 | | 10/2012 | Dondurur et al. | |

FOREIGN PATENT DOCUMENTS

| | | | |
|---|---|---|---|
| EP | 0957231 | A1 | 11/1999 |
| EP | 1079062 | A2 | 2/2001 |
| EP | 1584773 | A1 | 10/2005 |
| EP | 2060735 | A1 | 5/2009 |
| GB | 2348235 | A | 9/2000 |
| WO | WO9211425 | | 7/1992 |
| WO | WO0059344 | | 10/2000 |
| WO | WO0125584 | A1 | 4/2001 |

OTHER PUBLICATIONS

Big Game Treestands Triumph tripod, offered for sale on www.gandermountain.com website, last accessed Aug. 29, 2010.

Apex tripod and Pursuit tripod, offered for sale in Big Game Treestands section of Cabela's catalog, published at least as early as Dec. 26, 2011.

Faxko tripod ladder system product description, published at least as early as Dec. 26, 2011.

Guide Gear SGTS-13R 13 foot tripod product description, publication at least as early as 2009.

Guide Gear 13 foot tripod stand and Ladder Tree Stand Leveler Kit, offered for sale in Guide Gear catalog, published at least as early as Dec. 26, 2011.

Werner 8 foot fiberglass tripod ladder, offered for sale on Lowe's website at lowes.com at least as early as Dec. 18, 2012, last accessed Dec. 11, 2012.

* cited by examiner

LADDER AND RELATED METHODS

CROSS REFERENCE TO RELATED APPLICATIONS

This document claims the benefit of the filing date of U.S. Provisional Patent Application 61/580,570 entitled "Tripod Ladder and Methods of Use" to Robert C. Bogart et al., which was filed on Dec. 27, 2011, the disclosure of which is hereby incorporated entirely herein by reference.

BACKGROUND

1. Technical Field

Aspects of this document relate generally to ladders.

2. Background Art

Ladders generally include a vertical or inclined set of rungs or steps and are used, among other things, to allow a user to reach high locations.

SUMMARY

Implementations of a ladder may include: a step coupled to a primary leg; and an adjustable base coupled to the primary leg, the adjustable base including: a second base section coupled to the primary leg; a first base section rotatably coupled to the second base section, and; an adjuster configured to retain the first base section at one of a plurality of rotations with respect to the second base section.

Implementations of a ladder may include one, all, or any of the following:

The first base section may be configured to rotate relative to the second base section in a plane that is substantially parallel with a longest length of the step.

The second base section in implementations may be configured to not move relative to the primary leg.

The first base section may include a plurality of feet, each foot configured to rest upon a surface to support the ladder when the ladder is in an open, in-use configuration.

The first base section may be substantially entirely located beneath a bottommost extremity of the primary leg when the ladder is in an open, standing configuration.

The adjustable base may be configured to raise one foot of the first base section in response to a rotation of the first base section and simultaneously lower a different foot of the first base section in response to the rotation of the first base section.

The first base section may include a foot configured to contact a surface substantially directly below a bottommost extremity of the primary leg when the ladder is in an open, standing configuration.

The ladder may further have two primary legs, the step coupled to each primary leg, the ladder further having at least one secondary leg coupled to the primary legs proximate a top of the ladder, the first base section having a foot configured to contact a surface below the step, the foot positioned substantially centrally between two lines defined by longest lengths of two primary legs when the ladder is in an open, standing configuration.

The first base section may be coupled to the second base section only at a single juncture, the juncture configured to allow rotation of the first base section relative to the second base section.

The ladder may include at least three feet configured to contact a surface below the ladder when the ladder is in an open, standing configuration, and the at least three feet of the ladder may form a footprint that defines one of: vertices of an about equilateral triangle, and; vertices of an isosceles trapezoid that is not a rectangle.

The ladder may further include a secondary leg coupled to the primary leg proximate a top of the ladder and configured to have an adjustable length along a longest length of the secondary leg.

Implementations of a ladder may include: at least one primary leg; at least one step coupled to the at least one primary leg; at least one secondary leg coupled to the at least one primary leg proximate a top of the ladder; and a movable section coupled to the at least one primary leg with an arm and further coupled to the at least one secondary leg with an arm; the movable section having a substantially planar upper surface configured to generally face the top of the ladder when the ladder is in an open configuration and configured to generally face the top of the ladder when the ladder is in a closed configuration; wherein the movable section is configured to move upwards substantially towards the top of the ladder and downwards substantially away from the top of the ladder.

Implementations of a ladder may include one, all, or any of the following:

The at least one secondary leg may consist of two secondary legs, and each secondary leg may be configured to move in a plane that is about 120 degrees from a plane of movement of the other secondary leg.

The ladder may be configured to collapse towards a closed configuration in response to an upward movement of the movable section towards the top of the ladder.

The upper surface may be configured to generally face the top of the ladder during all configurations of the ladder between a fully closed configuration and a fully open configuration.

The ladder may be configured to open towards an opened configuration in response to a downward movement of the movable section away from the top of the ladder.

Implementations of a ladder may include: at least one step coupled to at least one primary leg; at least one secondary leg coupled to the at least one primary leg proximate a top of the ladder, and; a movable section coupled to the at least one primary leg, the movable section having a substantially planar, substantially horizontal upper surface; wherein the movable section is configured to collapse the ladder towards a closed configuration in response to an upward movement of the movable section towards the top of the ladder; wherein the movable section is configured to open the ladder towards an opened configuration in response to a downward movement of the movable section away from the top of the ladder, and; wherein the movable section is not configured to substantially rotate and is not configured to substantially tilt with respect to the top of the ladder when the ladder is being interchanged between an opened configuration and a closed configuration.

Implementations of a ladder may include one, all, or any of the following:

The movable section may include a handgrip having a cavity sized to receive a plurality of fingers of a user.

The movable section may include a coupling element configured to receive an end of a pole for the pole to push the movable section upwards towards the top of the ladder.

The at least one primary leg may consist of two primary legs, the at least one secondary leg may consist of two secondary legs, the movable section may be coupled to each primary leg through an arm and a hinge, and the movable section may be coupled to each secondary leg through an arm and a hinge.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Implementations will hereinafter be described in conjunction with the appended drawings, where like designations denote like elements, and.

DESCRIPTION

This disclosure, its aspects and implementations, are not limited to the specific components, assembly procedures or method elements disclosed herein. Many additional components, assembly procedures and/or method elements known in the art consistent with the intended ladder and related methods will become apparent for use with particular implementations from this disclosure. Accordingly, for example, although particular implementations are disclosed, such implementations and implementing components may comprise any shape, size, style, type, model, version, measurement, concentration, material, quantity, method element, step, and/or the like as is known in the art for such ladders and related methods, and implementing components and methods, consistent with the intended operation and methods.

Figure 1:
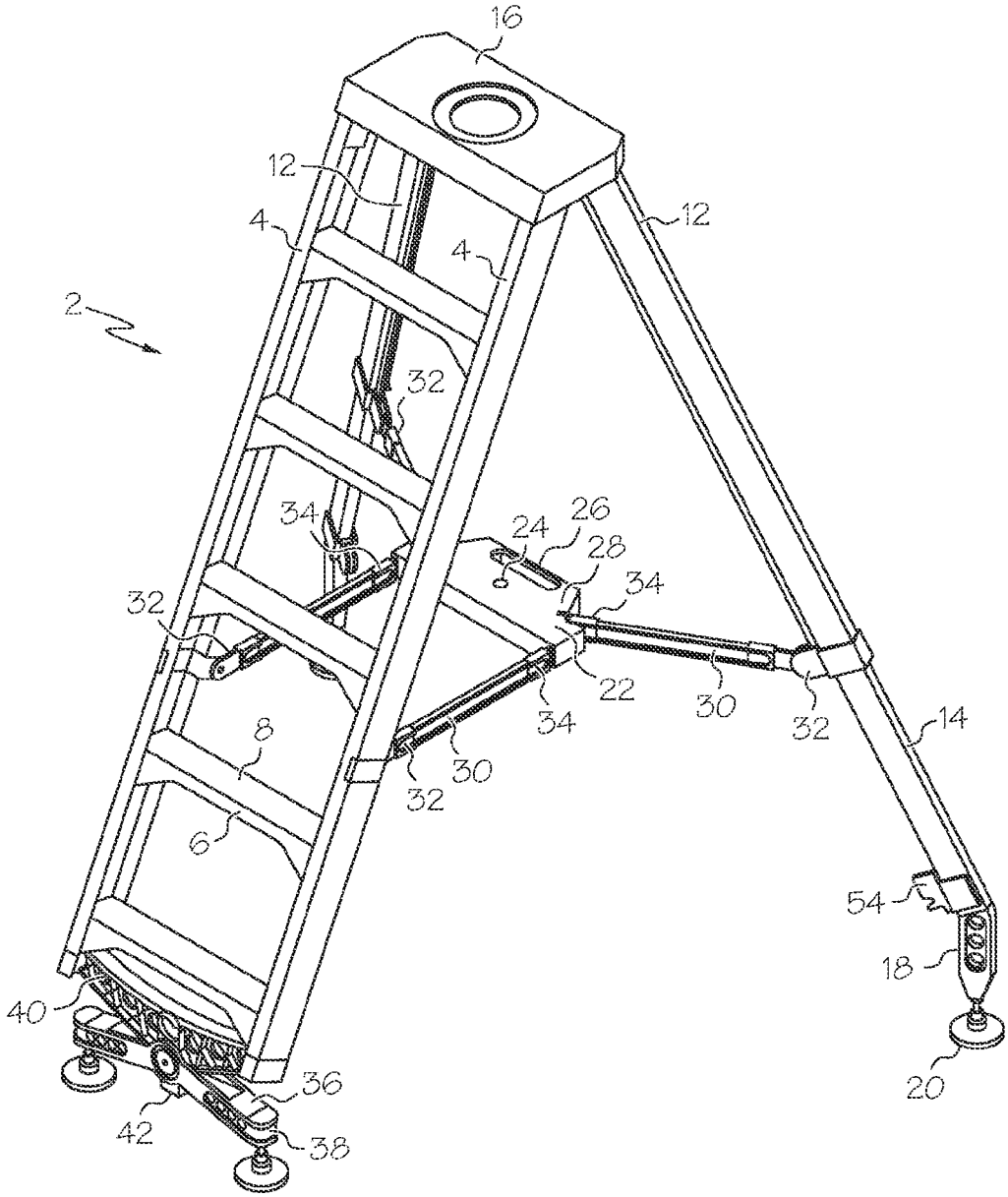
FIG. 1 is a perspective view of an implementation of a ladder in an open configuration.
Figure 4:
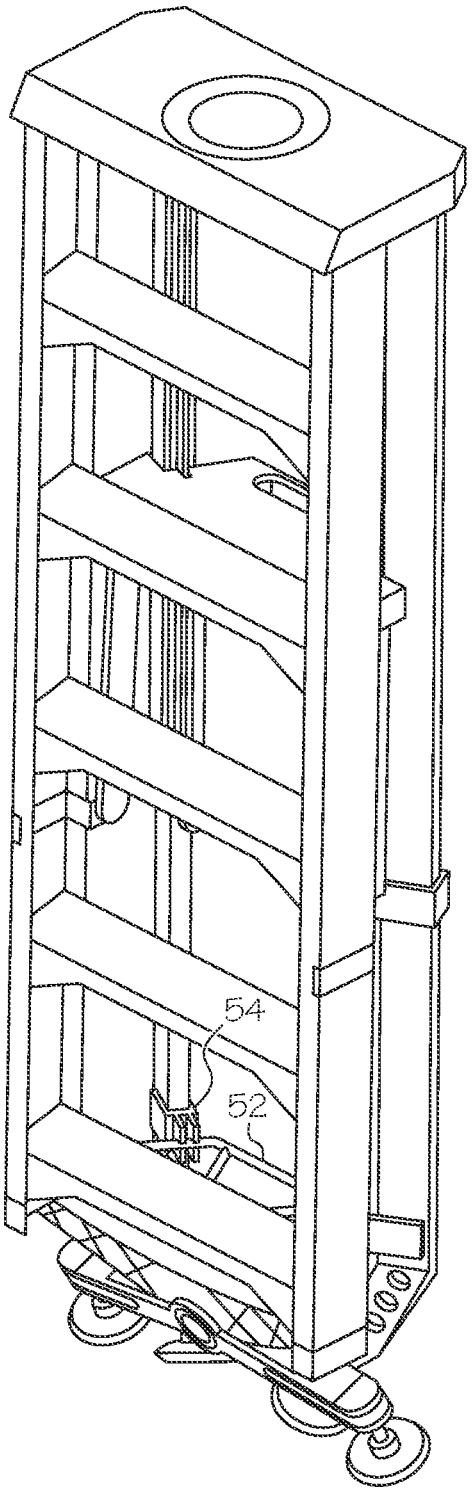
FIG. 4 is a perspective view of an implementation of a ladder in a closed configuration.
Figure 5:
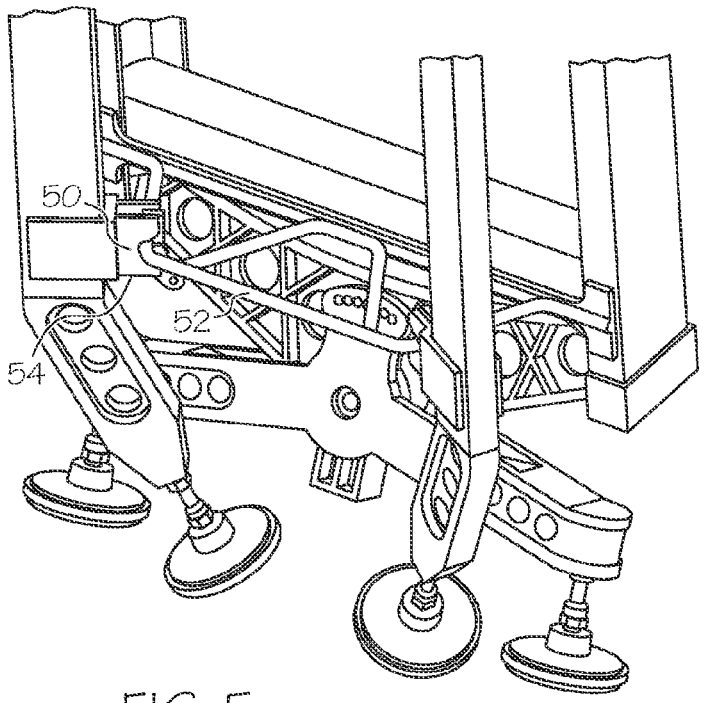
FIG. 5 is a rear perspective view of a lower portion of a ladder in a closed configuration.
Figure 6:
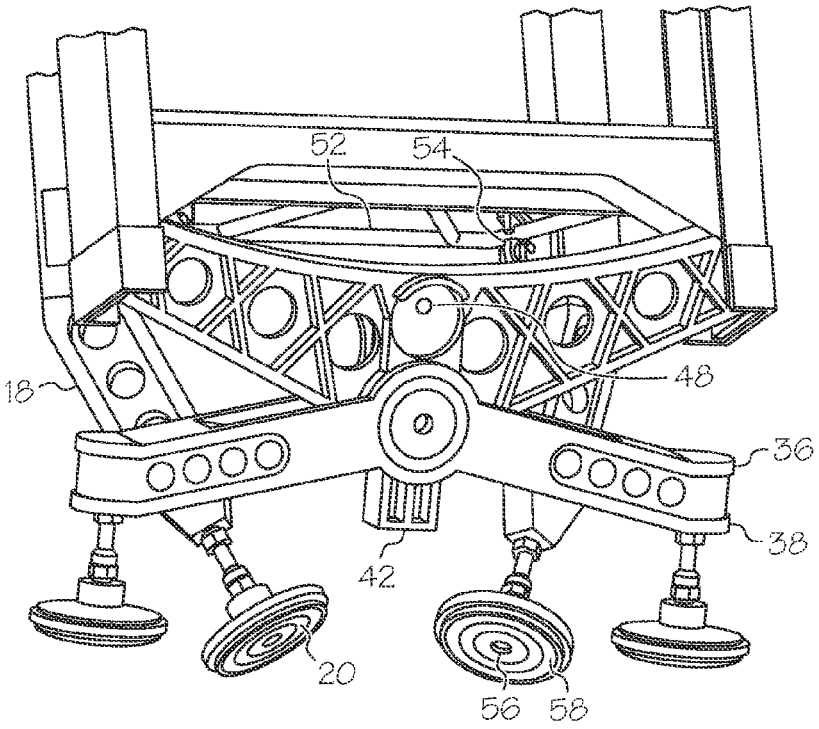
FIG. 6 is a front perspective view of a lower portion of a ladder in a closed configuration.

Referring now to FIG. 1, in implementations a ladder 2 comprises a plurality of primary legs 4 coupled to a top 16, a plurality of steps 6 coupled to the primary legs 4, a plurality of secondary legs 12 coupled to the top 16, and a movable section 22 coupled to each primary leg 4 through an arm 30 and further coupled to each secondary leg 12 through an arm 30. In implementations the arms 30 may have an I-beam cross section. In the implementation shown there are two primary legs 4, two secondary legs 12, one movable section 22, four arms 30, and five steps 6, the steps 6 coupling the two primary legs 4 together at each step 6. The ladder 2 in FIG. 1 is in an unfolded configuration. In implementations the ladder 2 in the unfolded configuration forms a substantially equilateral-triangle footprint. The ladder 2 in FIG. 4 is in a folded configuration.

Referring again to FIG. 1, in implementations the movable section 22 is coupled to each arm 30 through a second coupler 34, and each arm 30 is coupled to either a primary leg 4 or a secondary leg 12 through a first coupler 32. Thus in the implementations shown there are four first couplers 32. In the implementation shown the movable section 22 is coupled to four arms 30 through the use of four second couplers 34. The first couplers 32 and second couplers 34 in the implementations shown comprise hinges. Each first coupler 32 substantially allows freedom of movement of the arm 30 and respective primary leg 4 or secondary leg 12 along a plane coplanar with a plane containing lines defining the longest lengths of the respective arm 30 and primary leg 4 or secondary leg 12, respectively, while substantially limiting movement of the arm 30 and primary leg 4 or secondary leg 12 along other planes. Each second coupler 34 similarly substantially allows movement of each arm 30 relative to the movable section 22 along one plane (though that plane may move/shift during movement or folding/unfolding of the ladder 2) while substantially limiting movement along other planes relative to that plane. In other implementations the first couplers 32 and/or second couplers 34 could allow movement in more than one direction or plane. In implementations the movable section 22 is a shelf or tray (or includes a shelf and/or tray) for the placement of items such as, by non-limiting example, tools, paint, and the like, during use of the ladder 2.

The movable section 22 has a handgrip 26. When a user is unfolding the ladder 2 from the folded configuration to the unfolded configuration, the user may grip the handgrip 26 and pull it downward, and the downward movement of the movable section 22 will function to push the primary legs 4 away from the secondary legs 12 (and the secondary legs 12 away from one another) via the arms 30 until the unfolded configuration is achieved. The handgrip 26 may be included in an upper surface 28 of the movable section 22. In implementations the handgrip 26 may be a cavity which extends from the upper surface 28 of the movable section 22 to a lower surface of the movable section 22.

The movable section 22 also has a coupling element 24. In the implementations shown the coupling element 24 is a cavity roughly in the center of the movable section 22 which extends from the upper surface 28 of the movable section 22 to a lower surface of the movable section 22. A non-rigid pulling element, such as, by non-limiting example, a cord, rope, wire or the like, may be permanently or temporarily coupled to the movable section 22 via the coupling element 24. When the ladder 2 is in the folded configuration, the non-rigid pulling element may be pulled downward to effectuate unfolding the ladder 2 towards the unfolded configuration. A rigid pulling element, such as, by non-limiting example, a stick, pole, or the like, either temporarily or permanently coupled to the movable section 22 (such as via the coupling element 24) may be similarly used for the same purpose.

Additionally, a rigid element such as a stick, pole, or the like (including a standalone item or a portion of another item, such as the pole of a broom or shovel) could also be used to push the movable section 22 upwards while the ladder 2 is in the unfolded configuration in order to effectuate folding the ladder 2 toward the folded configuration. Such a rigid element could be temporarily or permanently coupled to the movable section 22 to push the movable section 22 upwards, such as via the coupling element 24. In other implementations the coupling element 24 could be something different from a cavity such as, by non-limiting example, a loop, threads, an indentation, and the like. In implementations wherein the ladder 2 is sufficiently tall that the movable section 22 is beyond the user's reach when the user is standing on the ground, the user may fold the ladder 2 to the folded configuration by using one of the above mentioned rigid elements to push the movable section 22 upwards.

Referring to FIGS. 1 and 4, in the implementations shown the largest planar surface of the movable section 22 remains substantially parallel with the largest planar surface of the top 16 in both the folded configuration and the unfolded configuration. In implementations the largest planar surface of the movable section 22 and largest planar surface of the top 16 remain substantially parallel at all times regardless of the configuration of the ladder 2. The longest length of each arm 30 is substantially parallel to the plane coplanar with the largest planar surface of the movable section 22 (and top 16) in the unfolded configuration and is substantially perpendicular thereto in the folded configuration. The longest length of each arm 30 is substantially parallel with the longest length of each primary leg 4 and with the longest length of each secondary leg 12 in the folded configuration. In implementations the largest planar surface of the movable section 22 and a plane containing lines defining the longest lengths of each arm 30 are substantially coplanar when the ladder 2 is in the unfolded configuration.

Referring still to FIG. 1, in implementations each secondary leg 12 may have an extendable section 14 which may be utilized to adjust the longest length of the secondary leg 12 to a desired length. This may be accomplished through the use of a pin and hole mechanism, such as an implementation wherein the extendable section 14 comprises holes and a pin is used in conjunction with the holes to lock the extendable section 14 to the desired length. The pin may be a spring-loaded pin biased towards engaging the holes such that it would be pulled outward away from the extendable section 14 (or alternatively an internal pin that is pushed inwards) to release the pin from a hole to adjust the extendable section 14 and released to engage a different hole to lock the extendable section 14 into place again.

In implementations each primary leg 4, secondary leg 12 and extendable section 14 has the shape of and/or is comprised of one or more or all of rectangular tubing, box tubing, square tubing, or one or more or all of rectangular tubing, box tubing, and/or square tubing with one side removed or missing along its longest length. Accordingly, each primary leg 4, secondary leg 12 and extendable section 14 may have a cross section perpendicular to its longest length, extending substantially along its longest length, having one or more or all of the following shapes: a hollow rectangle; a hollow square; a hollow rectangle with one side removed or missing; and a hollow square with one side removed or missing.

In the implementations shown each primary leg 4, secondary leg 12 and extendable section 14 comprises a shape of rectangular tubing with one side removed or missing substantially along its longest length, thus each primary leg 4, secondary leg 12 and extendable section 14 has a cross section perpendicular to its longest length and extending substantially along its longest length having a shape of a hollow rectangle with one side removed or missing though, as described above, in other implementations each may comprise the shape of rectangular tubing with all four sides such that the cross section of each perpendicular to its longest length and extending substantially along its longest length has a shape of a hollow rectangle with all four sides intact. In other implementations other shapes could be used, such that one or more or all of the primary legs 4, extendable sections 14 and/or secondary legs 12 could have a cross section perpendicular to its longest length and extending substantially along its longest length having a shape of, by non-limiting example, a triangle, a circle, an oval, or any other regular or irregular shape. In implementations the rectangular tubing shape or alternative shape of each extendable section 14 is sized to slide inside the rectangular tubing shape or alternative shape of a secondary leg 12.

Each secondary leg 12 is coupled to an upper foot section 18, and each upper foot section 18 is in turn coupled to a foot 20. The longest length of each upper foot section 18 in the implementations shown is set at an angle to the longest length of each secondary leg 12. In implementations this may align the bottom 58 of the foot 20 to be substantially parallel to a surface upon which the foot 20 is resting during use.

Figure 2:
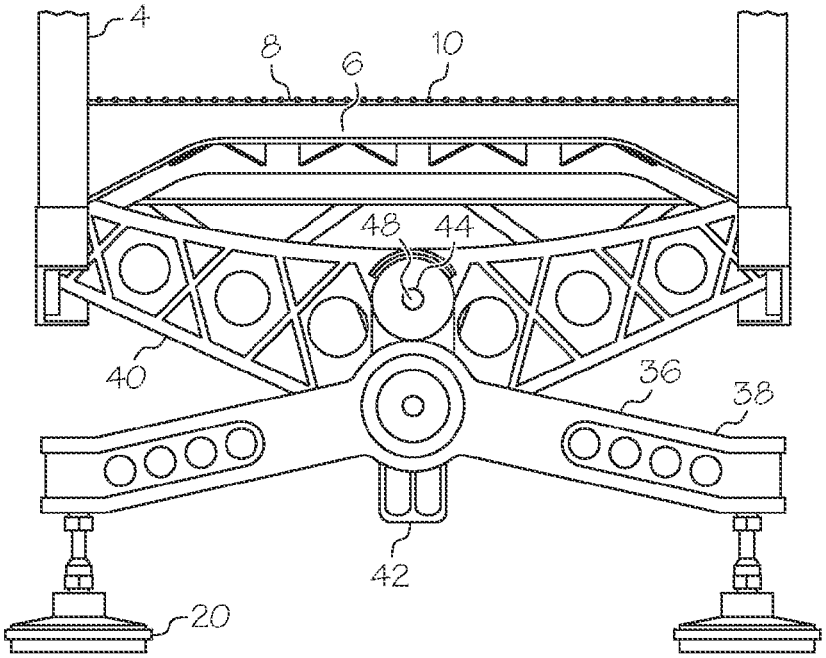
FIG. 2 is a front view of an implementation of an adjustable base and other elements of a ladder.

Referring now to FIGS. 1 and 2, an adjustable base 36 is coupled to the primary legs 4. The adjustable base 36 comprises a first base section 38 and a second base section 40 which are movably coupled together. In the implementations shown the first base section 38 and the second base section 40 are rotatably coupled to one another such that the first base section 38 and second base section 40 are movable along a plane coplanar with a plane wherein lie a line defining the longest length of the first base section 38 and a line defining the longest length of the second base section 40. In the implementations shown the first base section 38 and second base section 40 are not otherwise movable with respect to one another, though in other implementations the first base section 38 and second base section 40 may be otherwise movable with respect to one another.

The position of the first base section 38 and second base section 40 with respect to one another is adjusted with an adjuster 44. In the implementations shown the adjuster 44 comprises a pin and hole mechanism whereby a pin (not shown) engages a pin receiver 46 (shown in FIG. 3) through a pinhole 48 (shown in FIG. 2). The pin may be spring loaded such that it may be biased towards the engaged position, such that pulling it disengages it from the pin receiver 46, allowing the first base section 38 to be rotated to a desired position corresponding with the alignment of one of the plurality of pin receivers 46 and the pin, and then letting go of the pin such that it engages the corresponding pin receiver 46 to lock the first base section 38 at that rotation with respect to the second base section 40. This rotation of the first base section 38 may be utilized, for instance, when the ladder 2 is placed on an uneven surface, such that adjusting the rotation of the first base section 38 allows the ladder 2 to rest in a more stable position for use, such that, for instance, the steps 6 are substantially level in relation to a surface upon which the ladder 2 is resting. For example the rotation of the first base section 38 may position the upper surface 8 of each step 6 to be substantially perpendicular to a desired direction of ascension of the user although the upper surface 8 of each step 6 is substantially not parallel with the surface upon which the ladder 2 is resting, which surface may be, by non-limiting example, sloped, uneven, or the like. Thus each step 6 may be substantially level in relation to a sloped or uneven surface upon which the ladder 2 is resting.

Figure 3:
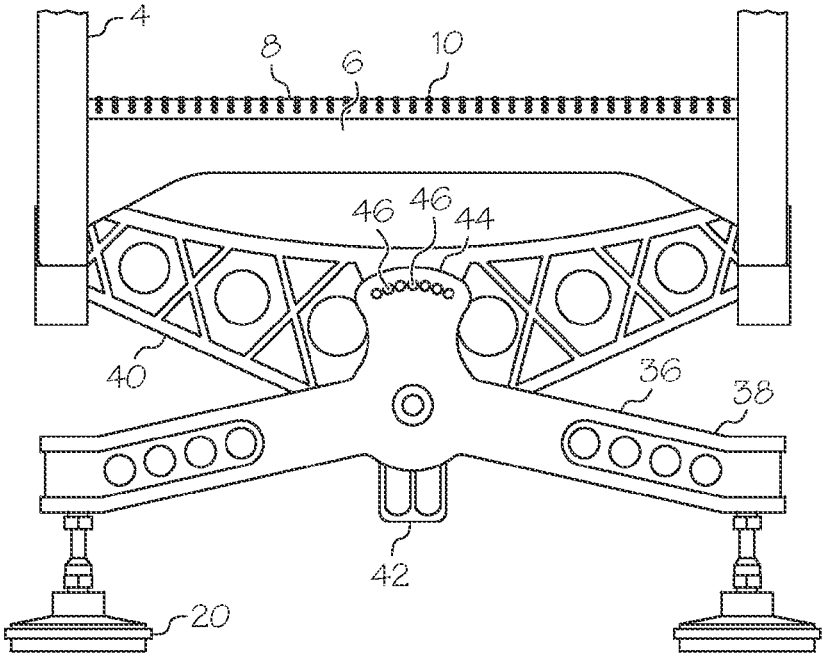
FIG. 3 is a rear view of an implementation of an adjustable base and other elements of a ladder.

In the implementations shown the ladder 2 has a foot 20 at the bottom of each secondary leg 12 and a foot 20 at each distal end of the first base section 38 substantially below the primary legs 4 and, when the adjustable base 36 is in a central, non-rotated setting, substantially aligned with the longest length of the primary legs 4 when the ladder 2 is viewed directly from the front or back (as seen in FIGS. 2 and 3). In implementations the feet 20 are removable, such as, by non-limiting example, by virtue of threads or a snap-in mechanism. The adjustable base 36 has a foot coupler 42 for coupling a foot 20 thereto in addition to or instead of coupling one or more of the shown feet 20 (shown in FIG. 2) to the first base section 38. For example, in implementations the feet 20 coupled to the first base section 38 could be removed and a foot 20 could be coupled to the foot coupler 42 so that the ladder 2 rests upon three feet 20 (one coupled to the foot coupler 42 and one coupled to each secondary leg 12).

Referring to FIGS. 1 and 4-6, the adjustable base 36 in implementations is positioned so that the largest planar surfaces (in implementations the flat bottoms) of the feet 20 coupled to the bottom of the adjustable base 36 are intentionally offset from perfect perpendicularity with the longest lengths of the primary legs 4. In implementations this may allow the bottoms 58 of the feet 20 coupled to the adjustable base 36 to rest substantially parallel to the surface upon which they are resting during use (or more parallel than would otherwise be possible) when the ladder 2 is unfolded and when the primary legs 4 are generally offset from perfect perpendicularity with the surface upon which the ladder 2 is resting.

In implementations one or more or all of the feet 20 may be individually movable with respect to other components of the ladder 2. By way of non-limiting example, in implementations one or more or all of the feet 20 could be coupled to a component or element of the ladder 2 using a ball joint or other mechanism that allows the foot 20 to rotate and/or tilt with respect to other elements of the ladder 2. Such a mechanism may allow the largest planar surface of the foot 20 (in implementations the bottom of the foot 20) to automatically tend towards, or to be manually adjusted towards, substantial parallelism with a surface upon which the ladder 2 is standing during use.

Referring to FIG. 3, the steps 6 have protrusions 10 on an upper surface 8 which may be utilized for increasing friction between the steps 6 and foot or shoe of a user or any other item. The steps 6 also have a curvature on their upper surface 8. In implementations the curvature may allow the user's foot or shoe or any other item to more easily grip the step 6 and/or generally increase the friction between the step 6 and the foot or shoe of a user or any other item during use. The curvature may be useful in instances where the upper surface 8 is not substantially parallel with the surface upon which the ladder 2 is resting or standing during use.

FIG. 4 shows the ladder 2 in a closed or folded configuration. One or more mechanisms may be used to selectively lock the ladder 2 in a closed configuration. For example, referring to FIGS. 4 and 5, a retainer 50 may be used to retain the ladder 2 in a folded configuration. In the implementations shown the retainer 50 comprises a bar 52 coupled to the primary legs 4 of the ladder 2 and a pair of bar receivers 54, each bar receiver 54 coupled to one of the secondary legs 12. When the ladder 2 is moved towards the closed or folded configuration the secondary legs 12 approach the primary legs 4 and the bar receivers 54 thusly receive the bar 52 and snap into a retained position. In implementations the removal of the bar 52 from the retained position relative to the bar receivers 54 may be facilitated and/or accomplished by, by non-limiting example, one or more or all of the following: manually extricating the bar 52 from the bar receivers 54; releasing a latch, the latch configured to remain in a latched position through the use of a spring or other bias mechanism; releasing a latch, the latch configured to switch from a latched position to an open position through the use of a spring or other bias mechanism; releasing a mechanical latch with a spring-loaded trigger, engaging a mechanical element configured to move the bar 52 in a direction away from the bar receivers 54; or the like. In implementations this retention may be overcome simply by pulling down on the movable section 22 as previously described in order to unfold the ladder 2. In other implementations other retention mechanisms could be used such as, by non-limiting example, a latch, a pin-and-hole retainer, and the like.

The foot 20 may have a coupler 56 used to couple the foot 20 to another element. For example, a larger foot (or an enlargement foot) may be desirable in instances where the ladder 2 is to rest on a sandy or otherwise unstable surface such that engaging more surface area of the surface upon which the foot 20 is resting would be desirable. The larger foot or enlargement foot may be coupled to the foot 20 and/or held in place via the coupler 56. The coupler 56 may comprise a cavity and/or may comprise threads for that purpose. An attachment with a rough or other surface or spikes may similarly be coupled to the foot 20 for similar purposes such as for better grip in wet conditions, in snow, and so forth. The foot 20 may also have, by non-limiting example, a slide-and-lock mechanism, threads, a snap-on mechanism, and or the like at an outer perimeter of the foot 20 or at another location on the foot 20 to allow the coupling of any of the above mentioned enlargement feet and/or attachments. The bottom 58 of the feet 20 may comprise rubber or another high-friction element to increase friction between the feet 20 and the surface(s) upon which the feet 20 are resting. In implementations the feet 20 may be cold molded with rubber being used for each bottom 58 and a hard plastic being used for the rest of each foot 20.

The ladder 2 may be made of conventional materials used to make goods similar in the art, such as, by non-limiting example, wood, metals such as aluminum and steel, polymers, plastics, rubber, fiberglass, composites, and the like. Those of ordinary skill in the art will readily be able to select appropriate materials and manufacture these products from the disclosures provided herein. In implementations the primary legs 4, secondary legs 12 and arms 30 may be formed from ladder-grade composite fiberglass formed using a pultrusion mechanism by Liberty Pultrusions of West Miffin, Pa. In implementations one or more or all of the arms 30, primary legs 4 and secondary legs 12 may have an I-beam cross section. In implementations, as described above, one or more or all of the primary legs 4, secondary legs 12 and extendable sections 14 may comprise rectangular, box, or square tubing or rectangular, box, or square tubing with one side removed or missing, and may thusly have a cross section of, by non-limiting example, a hollow square or rectangle or a hollow square or rectangle with one side removed or missing. In implementations the upper foot section 18 comprises a polymer.

In implementations one or more or all of the following elements: the top 16; steps 6; second base section 40; adjustable base 36; and first base section 38, may comprise one or more or all of the following materials: Omni PA6 IM 8 UV BK2000 Impact Modified Nylon 6 w/UV Black; Omni PA6 UGR33 UV BK2000 Impact Modified Nylon 6 w/UV Black. In implementations top 16 and steps 6 comprise Omni PA6 IM 8 UV BK2000 Impact Modified Nylon 6 w/UV Black while the adjustable base 36, first base section 38 and second base section 40 comprise Omni PA6 UGR33 UV BK2000 Impact Modified Nylon 6 w/UV Black.

Other aspects of the ladder 2 may be found in U.S. Pat. No. 6,206,139 to Robert C. Bogart, Jr., issued Mar. 27, 2001, titled "Folding Tripod Ladder Having Extendable Legs."

In implementations a method of using a ladder 2 may comprise one, more, or all of the following: adjusting a longest length of a secondary leg 12 through the use of an extendable section 14; adjusting a longest length of both secondary legs 12 through the use of extendable sections 14; adjusting a position of the first base section 38 and second base section 40 with respect to one another with an adjuster 44; opening the ladder 2 to an open configuration by moving a movable section 22 downwards; closing the ladder 2 to a closed configuration by moving a movable section 22 upwards; retaining the ladder 2 in a closed position by receiving a bar 52 with bar receivers 54; and extricating the ladder 2 from a retained closed position by removing the bar 52 from the bar receivers 54.

Implementations of a ladder 2 may incorporate one or more or all elements, aspects, configurations or the like of ladders and other devices that are described in U.S. Pat. No. 6,206,139 to Robert C. Bogart, Jr., issued Mar. 27, 2001, entitled "Folding Tripod Ladder Having Extendable Legs," the disclosure of which is incorporated entirely herein by reference. Conventional ladders and other devices are described in the following references: U.S. Pat. No. 4,524,849 to Riddle, issued Jun. 25, 1985, entitled "Tripod"; U.S. Pat. No. 160,081 to P. P. Carnes, issued Feb. 23, 1875, entitled "Firemen's Ladder"; U.S. Pat. No. 5,590,739 to High et al., issued Jan. 7, 1997, entitled "Adjustable extension stepladder"; U.S. Pat. No. 6,874,598 to Baker, issued Apr. 5, 2005, entitled "Ergonomically improved tripod stepladder"; U.S. Pat. No. 3,878,917 to McBride, issued Apr. 22, 1975, entitled "Adjustable ladder support attachment"; U.S. Pat. No. D507,079 to Drum, issued Jul. 5, 2005, entitled "Tripod legs and ladder for wildlife feeder"; U.S. Pat. No. 4,646,876 to Grawi, issued Mar. 3, 1987, entitled "Walking ladder"; European Pat. App. Pub. No. EP2060735(A1), published May 20, 2009, naming Jennhwa Alan Lo as inventor and entitled "Tripod stepladder with removable extensions"; European Pat. App. Pub. No. EP1584773(A1), published Oct. 12, 2005, naming Frédéric Ladurée as inventor and entitled "Tripod stand for legs of scaffolding and feet of ladder with automatic level correction on very irregular ground"; European Pat. App. Pub. No. EP1218616(B1), published May 6, 2009, naming Eckhard Klein as inventor and entitled "Ladder scaffolding with lean-to ladder"; U.S. Pat. App. Pub. No. 20100252364, published Oct. 7, 2010, naming Vestal et al. as inventors and entitled "Collapsible safe ladder"; UK Pat. App. Pub. No. GB2348235A, published Sep. 27, 2000, naming David Richard Hendrik Veen as inventor and entitled "Adjustable extension for ladder leg with swivel foot"; U.S. Pat. No. D373,428 to Nashleanas et al., issued Sep. 3, 1996, entitled "Adjustable stabilizer foot for a ladder"; European Pat. App. Pub. No. EP0940555(A2), published Sep. 8, 1999, naming Bruno Stehle as inventor and entitled "Free-standing ladder"; European Pat. App. Pub. No. EP1079062(A2), published Feb. 28, 2001, naming Bryan Philips as inventor and entitled "Step ladder"; European Pat. App. Pub. No. EP0047151(A2), published Mar. 10, 1982, naming Patrick Yelverton Williams as inventor and entitled "Ladder levelling arrangements"; U.S. Pat. No. 1,733,338 to Enke, issued Oct. 29, 1929, entitled "Adjustable foot support for ladders"; U.S. Pat. No. 1,280,741 to Hunn, issued Oct. 8, 1918, entitled "Adjustable foot for ladders"; U.S. Pat. No. 1,088,169 to Osterhoudt, issued Feb. 24, 1914, entitled "Adjustable foot for ladders"; U.S. Pat. No. 1,589,743 to Clary, issued Jun. 22, 1926, entitled "Adjustable and reversible ladder foot"; U.S. Pat. No. 1,551,395 to Husted, issued Aug. 25, 1925, entitled "Adjustable foot device for ladders"; U.S. Pat. No. 1,088,168 to Osterhoudt, issued Feb. 24, 1914, entitled "Adjustable foot for ladders"; U.S. Pat. No. 5,678,656 to Lanzafame, issued Oct. 21, 1997, entitled "Positive engaging ladder stabilizing and leveling device"; U.S. Pat. App. Pub. No. 20120048647, published Mar. 1, 2012, naming Green et al. as inventors and entitled "Collapsible safe ladder"; WIPO PCT App. Pub. No. WO0059344, published Oct. 12, 2000, naming Gwynneth as inventor and entitled "Self stabilising system"; U.S. Pat. No. 3,964,574 to Bentivegna, issued Jun. 22, 1976, entitled "Ladder leveling device"; U.S. Pat. No. 4,497,390 to Wilson, issued Feb. 5, 1985, entitled "Self-adjusting ladder"; U.S. Pat. No. 6,672,427 to Sheffield, issued Jan. 6, 2004, entitled "Ladder base stabilizer"; U.S. Pat. No. 5,542,497 to Macyszyn, issued Aug. 6, 1996, entitled "Ladder level adjusting attachment"; U.S. Pat. No. 7,036,633 to Lanzafame, issued May 2, 2006, entitled "Quick release for ladder levelers"; U.S. Pat. No. 5,845,744 to Beck et al., issued Dec. 8, 1998, entitled "Ladder levelling device"; U.S. Pat. No. 5,853,065 to Hutson et al., issued Dec. 29, 1998, entitled "Adjustable leg ladder assembly"; U.S. Pat. No. 6,044,929 to Wishner, issued Apr. 4, 2000, entitled "Ladder leveling device"; U.S. Pat. No. 4,766,976 to Wallick, Jr., issued Aug. 30, 1988, entitled "Ladder leg extender and leveler"; U.S. Pat. No. 4,085,820 to Cerny, issued Apr. 25, 1978, entitled "Ladder leveler"; U.S. Pat. No. 5,064,024 to Barham, issued Nov. 12, 1991, entitled "Ladder leg extender apparatus with improved vertical adjustment means"; U.S. Pat. No. 3,933,221 to Sorenson, issued Jan. 20, 1976, entitled "Ladder adjusting and stabilizing apparatus"; U.S. Pat. No. 5,526,898 to Clark, issued Jun. 18, 1996, entitled "Leg extension assembly"; U.S. Pat. No. 5,335,754 to Gibson, issued Aug. 9, 1994, entitled "Self-levelling ladder"; U.S. Pat. No. 6,253,876 to Cosgrave et al., issued Jul. 3, 2001, entitled "Ladder stabilizer apparatus"; U.S. Pat. No. 5,012,895 to Santos, issued May 7, 1991, entitled "Ladder stabilizer comprising top extension arms and attached stabilizer bars"; U.S. Pat. App. Pub. No. 20020178683, published Dec. 5, 2002, naming Phillips as inventor, entitled "Flat folding scaffold system with shrubbery shelter"; U.S. Pat. No. 3,858,684 to Goings, issued Jan. 7, 1975, entitled "Telescoping ladder"; U.S. Pat. No. 6,688,426 to Mikros, issued Feb. 10, 2004, entitled "Wheel extension and lift device for ladders"; U.S. Pat. No. 4,978,098 to Peckinpaugh, issued Dec. 18, 1990, entitled "Adjustable support"; U.S. Pat. No. 6,810,995 to Warford, issued Nov. 2, 2004, entitled "Portable stairs with adjustable landing platform height"; U.S. Pat. No. 4,135,690 to Clarke et al., issued Jan. 23, 1979, entitled "Adjustable angle floor support"; U.S. Pat. No. 6,910,666 to Burr, issued Jun. 28, 2005, entitled "Adjustable leveling mount"; U.S. Pat. No. 4,949,809 to Levi et al., issued Aug. 21, 1990, entitled "Extendable pole locking mechanism for ladder stabilizer"; U.S. Pat. No. 5,154,255 to Kiska et al., issued Oct. 13, 1992, entitled "Ladder shoe and method of use"; U.S. Pat. No. 6,158,551 to Gray, issued Dec. 12, 2000, entitled "Extension ladder shelf"; U.S. Pat. No. 3,693,756 to Walker et al., issued Sep. 26, 1972, entitled "Ladder stabilizer"; U.S. Pat. No. D273,996 to Rasler, issued May 22, 1984, entitled "Ladder-mounted utility shelf"; U.S. Pat. No. 5,058,707 to Waid, issued Oct. 22, 1991, entitled "Work shelf for a folding stepladder"; U.S. Pat. No. 6,698,699 to Bailey, issued Mar. 2, 2004, entitled "Working material retaining accessory"; U.S. Pat. No. 839,087 to Adler, issued Dec. 25, 1906, entitled "Ladder"; U.S. Pat. No. 7,887,016 to Gunsaullus, issued Feb. 15, 2011, entitled "All terrain material and tool tray"; U.S. Pat. No. 5,715,909 to Gagnon, issued Feb. 10, 1998, entitled "Stepladder including a bracing shelf"; U.S. Pat. No. D380,559 to Sweeney, issued Jul. 1, 1997, entitled "Shelf platform"; U.S. Pat. No. 2,930,442 to Carter, issued Mar. 29, 1960, entitled "Stepladder attachment"; U.S. Pat. No. 4,418,793 to Brent, issued Dec. 6, 1983, entitled "Ladder aid device"; U.S. Pat. No. D388,882 to Kain, issued Jan. 6, 1998, entitled "Combined work ladder and platform"; U.S. Pat. No. 8,186,481 to Moss et al., issued May 29, 2012, entitled "Ladders, ladder components and related methods"; U.S. Pat. No. 7,967,264 to Peterson, issued Jun. 28, 2011, entitled "Ladder attached support bracket and paint can and roller pan holders for use therewith"; U.S. Pat. No. 6,341,666 to Allen, issued Jan. 29, 2002, entitled "Stepladder accessory tray"; U.S. Pat. No. 6,502,664 to Peaker, Sr., issued Jan. 7, 2003, entitled "Accessorized stepladder"; U.S. Pat. No. 7,051,837 to Brahier, issued May 30, 2006, entitled "Folding workbench and dolly combination"; U.S. Pat. No. 6,098,749 to Enochs, issued Aug. 8, 2000, entitled "Work holder"; U.S. Pat. No. 4,331,217 to Stecklow, issued May 25, 1982, entitled "Ladder step and stabilizer"; U.S. Pat. No. 3,042,142 to Butler, issued Jul. 3, 1962, entitled "Step-ladder attachment"; U.S. Pat. No. 6,145,620 to Strunk, issued Nov. 14, 2000, entitled "Work support assembly for use with stepladder"; U.S. Pat. No. 5,584,357 to Gugel et al., issued Dec. 17, 1996, entitled "Ladder"; U.S. Pat. No. 5,791,437 to Figliuzzi, issued Aug. 11, 1998, entitled "Ladder with nesting brace gusset plate hinge"; U.S. Pat. No. 5,044,468 to Worthington, Jr., issued Sep. 3, 1991, entitled "Ladder leveling device"; U.S. Pat. Pub. No. 20120261214, published Oct. 18, 2012, naming Dondurur et al. as inventors, entitled "Safety ladder"; U.S. Pat. Pub. No. 20080078616, published Apr. 3, 2008, naming Ursitti as inventor, entitled "Self leveling ladder system"; U.S. Pat. No. 4,600,080 to Forrester, issued Jul. 15, 1986, entitled "Three-legged stepladder"; U.S. Pat. No. 4,618,027 to Piretti, issued Oct. 21, 1986, entitled "Folding ladder with three stiles", and; European Pat. App. Pub. No. EP0957231 (A1), published Nov. 17, 1999, naming Charalambous et al. as inventors, entitled "Ladder".

Conventional ladders and other devices are further disclosed in the following references, corresponding disclosures of which are filed together with this application: the AMERISTEP RAPTOR tripod and/or GRIZZLY tripod which were offered for sale on the huntingfishingdirect.com website; the BIG GAME TREESTANDS TRIUMPH 16' tripod which was offered for sale on the gandermountain-.com website; the APEX tripod and PURSUIT 12-ft. tripod which was offered for sale in a BIG GAME TREESTANDS section of a CABELA'S product catalog; the FAXKO tripod ladder system which was disclosed in a product description filed with this application; the GUIDE GEAR SGTS-13R 13 ft. tripod which was described in a product description filed with this application; the GUIDE GEAR 13' tripod stand and LADDER TREE STAND LEVELER KIT which were offered for sale in a GUIDE GEAR catalog, and; a WERNER 8 ft. fiberglass tripod ladder which was offered for sale by LOWE'S on the lowes.com website.

In implementations the ladder 2 comprises a tripod ladder.

In implementations of a ladder 2 may include a step 6 coupled to a primary leg 4 and an adjustable base 36 coupled to the primary leg 4, the adjustable base 36 including: a second base section 40 coupled to the primary leg 4; a first base section 38 rotatably coupled to the second base section 40, and; an adjuster 44 configured to retain the first base section 38 at one of a plurality of rotations with respect to the second base section 40.

In implementations the first base section 38 may be configured to rotate relative to the second base section 40 in a plane that is substantially parallel with a longest length of the step 6.

The second base section 40 in implementations may be configured to not move relative to the primary leg 4.

The first base section 38 may include a plurality of feet 20, each foot 20 configured to rest upon a surface to support the ladder 2 when the ladder 2 is in an open, in-use configuration.

The first base section 38 may be substantially entirely located beneath a bottommost extremity of the primary leg 4 when the ladder 2 is in an open, standing configuration.

The adjustable base 36 may be configured to raise one foot 20 of the first base section 38 in response to a rotation of the first base section 38 and simultaneously lower a different foot 20 of the first base section 38 in response to the rotation of the first base section 38.

The first base section 38 may include a foot 20 configured to contact a surface substantially directly below a bottommost extremity of the primary leg 4 when the ladder 2 is in an open, standing configuration.

The ladder 2 may further have two primary legs 4, the step 6 coupled to each primary leg 4, the ladder 2 further having at least one secondary leg 12 coupled to the primary legs 4 proximate a top 16 of the ladder 2, the first base section 38 having a foot 20 configured to contact a surface below the step 6, the foot 20 positioned substantially centrally between two lines defined by longest lengths of two primary legs 4 when the ladder 2 is in an open, standing configuration.

The first base section 38 may be coupled to the second base section 40 only at a single juncture, the juncture configured to allow rotation of the first base section 38 relative to the second base section 40.

The ladder 2 may include at least three feet 20 configured to contact a surface below the ladder 2 when the ladder 2 is in an open, standing configuration, and the at least three feet 20 of the ladder 2 may form a footprint that defines one of: vertices of an about equilateral triangle, and; vertices of an isosceles trapezoid that is not a rectangle.

The ladder 2 may further include a secondary leg 12 coupled to the primary leg 4 proximate a top 16 of the ladder 2 and configured to have an adjustable length along a longest length of the secondary leg 12.

Implementations of a ladder 2 may include: at least one primary leg 4; at least one step 6 coupled to the at least one primary leg 4; at least one secondary leg 12 coupled to the at least one primary leg 4 proximate a top 16 of the ladder 2; and a movable section 22 coupled to the at least one primary leg 4 with an arm 30 and further coupled to the at least one secondary leg 12 with an arm 30; the movable section 22 having a substantially planar upper surface 28 configured to generally face the top 16 of the ladder 2 when the ladder 2 is in an open configuration and configured to generally face the top 16 of the ladder 2 when the ladder 2 is in a closed configuration; wherein the movable section 22 is configured to move upwards substantially towards the top 16 of the ladder 2 and downwards substantially away from the top 16 of the ladder 2.

In implementations the at least one secondary leg 12 may consist of two secondary legs 12, and each secondary leg 12 may be configured to move in a plane that is about 120 degrees from a plane of movement of the other secondary leg 12.

The ladder 2 may be configured to collapse towards a closed configuration in response to an upward movement of the movable section 22 towards the top 16 of the ladder 2.

The upper surface 28 may be configured to generally face the top 16 of the ladder 2 during all configurations of the ladder 2 between a fully closed configuration and a fully open configuration.

The ladder 2 may be configured to open towards an opened configuration in response to a downward movement of the movable section 22 away from the top 16 of the ladder 2.

Implementations of a ladder 2 may include: at least one step 6 coupled to at least one primary leg 4; at least one secondary leg 12 coupled to the at least one primary leg 4 proximate a top 16 of the ladder 2, and; a movable section 22 coupled to the at least one primary leg 4, the movable section 22 having a substantially planar, substantially horizontal upper surface 28; wherein the movable section 22 is configured to collapse the ladder 2 towards a closed configuration in response to an upward movement of the movable section 22 towards the top 16 of the ladder 2; wherein the movable section 22 is configured to open the ladder 2 towards an opened configuration in response to a downward movement of the movable section 22 away from the top 16 of the ladder 2, and; wherein the movable section 22 is not configured to substantially rotate and is not configured to substantially tilt with respect to the top 16 of the ladder 2 when the ladder 2 is being interchanged between an opened configuration and a closed configuration.

In implementations the movable section 22 may include a handgrip 26 having a cavity sized to receive a plurality of fingers of a user.

The movable section 22 may include a coupling element 24 configured to receive an end of a pole for the pole to push the movable section 22 upwards towards the top 16 of the ladder 2.

The at least one primary leg 4 may consist of two primary legs 4, the at least one secondary leg 12 may consist of two secondary legs 12, the movable section 22 may be coupled to each primary leg 4 through an arm 30 and a hinge, and the movable section 22 may be coupled to each secondary leg 12 through an arm 30 and a hinge.

In places where the description above refers to particular implementations of a ladder and related methods and implementing components, sub-components, methods and sub-methods, it should be readily apparent that a number of modifications may be made without departing from the spirit thereof and that these implementations, implementing components, sub-components, methods and sub-methods may be applied to other ladders and related methods. The terms "comprising," "comprises" and any variation, as used herein with respect to a list of method elements or article elements, are intended to be non-exclusive and convey that the method or article may include non-listed elements. For example, a list indicating that an article "comprises A, B and C" includes an article that has A, B and C and also includes an article that has A, B, C, D, E and F.

What is claimed is:

1. A ladder comprising:

two primary legs;

at least one step coupled to the two primary legs;

two secondary legs coupled to the two primary legs proximate a top of the ladder;

a movable section coupled to at least one of the two primary legs, the movable section comprising a substantially planar, major substantially horizontal upper surface of a shelf, wherein the upper surface of the shelf is configured to place tools and paint thereon; wherein the movable section is configured to collapse the ladder towards a closed configuration in response to an upward movement of the movable section towards the top of the ladder;

wherein the movable section is configured to open the ladder towards an open configuration in response to a downward movement of the movable section away from the top of the ladder;

wherein the upper surface of the shelf is not configured to substantially rotate when the ladder is being interchanged between the open configuration and the closed configuration, and wherein the upper surface of the shelf is not configured to substantially tilt with respect to the top of the ladder when the ladder is being interchanged between the open configuration and the closed configuration;

wherein the movable section is coupled to each of the two primary legs through a respective arm and a respective hinge, wherein the movable section is coupled to each of the two secondary legs through a respective arm and a respective hinge, wherein the four arms are coupled with the movable section, and;

wherein longest lengths of only two of the four arms are parallel when the ladder is in the open configuration.

2. The ladder of claim 1, wherein each secondary leg is configured to move in a plane of movement that is about 120 degrees from a plane of movement of the other secondary leg, the planes of movement being defined as planes in which the two secondary legs move in order to facilitate the ladder converting between the open configuration and the closed configuration.

3. The ladder of claim 1, wherein the substantially planar upper surface is configured to generally face the top of the ladder during all configurations of the ladder between the closed configuration and the open configuration.

4. The ladder of claim 1, wherein the movable section comprises a handgrip comprising a cavity sized to receive a plurality of fingers of a user.

5. The ladder of claim 1, wherein the movable section comprises a coupling element configured to receive an end of a pole for the pole to push the movable section upwards towards the top of the ladder.

6. The ladder of claim 1, wherein the movable section is not coupled to the at least one step except through the four arms.

7. The ladder of claim 6, wherein the longest lengths of all of the four arms are coplanar when the ladder is in the open configuration.

8. The ladder of claim 1, wherein the longest length of each of the four arms is in a plane parallel with a plane including a longest length of the at least one step when the ladder is in the open configuration.

* * * * *